United States Patent [19]

Yuen

[11] Patent Number: 4,577,365

[45] Date of Patent: Mar. 25, 1986

[54] RECHARGEABLE VACUUM CLEANER

[75] Inventor: John S. Yuen, Kwun Tong, Hong Kong

[73] Assignee: John Manufacturing Limited, Kowloon, Hong Kong

[21] Appl. No.: 647,454

[22] Filed: Sep. 5, 1984

[30] Foreign Application Priority Data

Sep. 14, 1983 [GB] United Kingdom ..... 8324628

[51] Int. Cl.[4] ..... A47L 5/24

[52] U.S. Cl. ..... 15/339; 15/340; 15/350; 15/412; 200/322

[58] Field of Search ..... 15/339, 344, 412, 350; 200/321, 322

[56] References Cited

U.S. PATENT DOCUMENTS

| | | | |
|---|---|---|---|
| 2,753,434 | 7/1956 | Storm | 15/339 X |
| 3,379,852 | 4/1968 | Korshak | 200/322 X |
| 3,477,087 | 11/1969 | Robinson | 15/344 |
| 4,209,875 | 7/1980 | Pugh et al. | 15/344 |
| 4,280,026 | 7/1981 | Alessio | 200/321 X |
| 4,513,470 | 4/1985 | Toya | 15/339 X |

FOREIGN PATENT DOCUMENTS

| | | | |
|---|---|---|---|
| 1453075 | 2/1969 | Fed. Rep. of Germany | 15/350 |

*Primary Examiner*—Chris K. Moore

*Attorney, Agent, or Firm*—Beall Law Offices

[57] ABSTRACT

A rechargeable vacuum cleaner has a housing having a front portion with an intake nozzle therein, a body portion and a handle portion, with the body portion mounting a motor fan suction unit and a filter and having outlet apertures therein for air from the motor fan suction unit. The handle portion provides means for holding the rechargeable vacuum cleaner, houses the rechargeable battery and incorporates a socket whereby the battery can be connected to charging means. The filter arrangement comprises a disc of flexible filter material sandwiched between two annular members, one of which defines a grid framework over which the disc of flexible filter material is stretched when said one of the members is telescopically received within the other of the members with the filter material located therebetween.

2 Claims, 6 Drawing Figures

RECHARGEABLE VACUUM CLEANER

The invention relates to a rechargeable vacuum cleaner.

A rechargeable vacuum cleaner, that is to say a vacuum cleaner powered by an electric battery which is rechargeable, has many uses, for example, removing dust, dirt and grit from the interiors of motor cars or clearing crumbs from a tablecloth after a meal, particularly when it would be inconvenient or impossible to plug in a mains powered vacuum cleaner due for example to there being no adjacent mains outlet socket.

According to the invention a rechargeable vacuum cleaner comprises a housing formed to present an intake nozzle, a body portion and a handle portion, with the body portion mounting a motor fan suction unit and a filter arrangement and having outlet apertures therein for air from the motor fan suction unit and the handle portion providing means for holding the rechargeable vacuum cleaner, housing the rechargeable battery and incorporating a socket whereby the battery can be connected to charging means therefore.

Preferably the filter arrangement comprises a disc of flexible filter material so mounted as completely to obstruct a passageway within the housing for air flowing from the intake nozzle to the motor fan suction unit such that all air passing through the passageway must pass through the disc of flexible filter material. Preferably the disc of flexible filter material is sandwiched between two annular members, preferably of thermoplastics material, one of which defines a grid framework over which the disc of flexible filter material is stretched when said one of the members is telescopically received within the other of the members with the filter material located therebetween. Thus the filter material can be rapidly replaced if required and can readily be removed for cleaning.

Preferably the motor fan unit comprises a motor mounted on a spider received and located within the housing, which housing is preferably provided in two parts with the joint faces between the two parts lying in a plane extending generally parallel to the axis of the motor fan unit. The fan is advantageously of the centrifugal kind comprising a pair of spaced discs with arcuate webs extending therebetween, each arcuate web extending from the periphery of the wheel generally towards the center with the upstream one of the discs having a central aperture therein for air inlet.

The downstream one of the discs preferably bears, on its downstream face, ribs which cause flow of a current of air onto an upstream end plate of the motor, which upstream end plate is apertured to enable the air flow to pass through the motor and out of apertures adjacent the downstream end of the motor. The ribs are preferably linear ribs and four ribs are provided with their inner ends lying at the four corners of a square which has the axis of the fan at its centre and the four outer ends lying at the four corners of a square and with the two squares axially rotated with respect to one another through 45°.

Preferably the motor fan unit is controlled by a push-button switch and a safety switch is provided of the slidable kind such that in one position to which it can be slid it allows the button to be depressed and in the other position it does not so allow the button to be depressed.

The invention is diagrammatically illustrated by way of example in the accompanying drawings in which.

Figure 1:
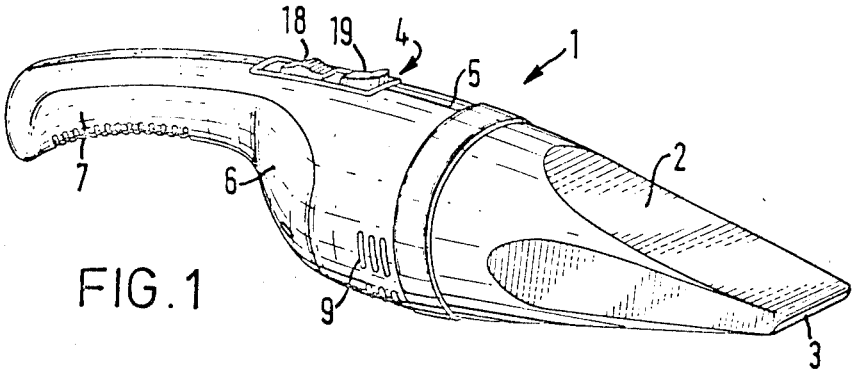
FIG. 1 is a perspective view of a rechargeable vacuum cleaner according to the invention from the front, one side and above.
Figure 2:
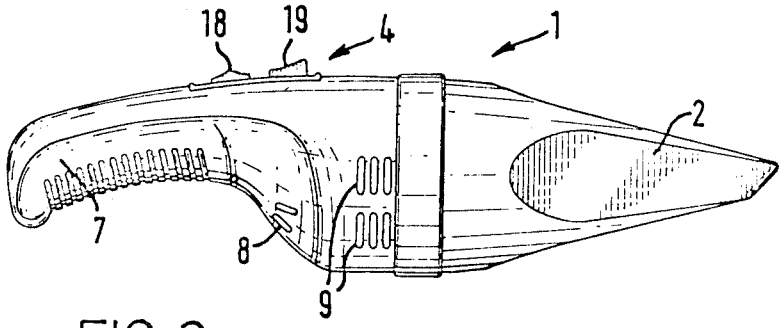
FIG. 2 is a side view of the vacuum cleaner of FIG. 1.

Referring to the drawings and firstly to FIGS. 1 and 2, a rechargeable vacuum cleaner generally indicated at 1, has a front end housing portion 2 formed in one part and presenting an inlet nozzle 3. The rear end of the housing portion 2 is engageable by a bayonet fitting (not shown) on the front end of a rear body portion 4. The rear body portion 4 is provided in two halves with the upper joint line 5 being just visible in FIG. 1, the two halves defining a closed housing with a front portion 6 on which the housing portion 2 is engaged and a rear handle portion 7. The portion 6 includes air outlet apertures 8 and 9.

Figure 3:
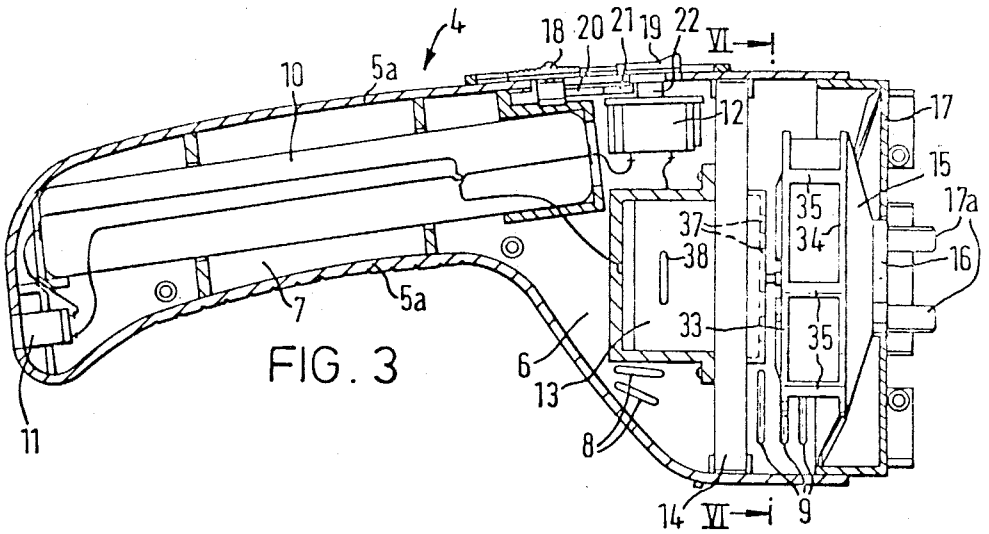
FIG. 3 is a view taken from the same angle as FIG. 2 but with the front end of the housing removed and with half of the rear housing removed to show internal details.

Referring to FIGS. 3 to 6 and firstly to FIG. 3, the left-hand side rear housing portion 4 is shown therein and particularly a joint face 5*a* thereof which matches with a similar joint face of the right-hand rear housing portion 4. Mounted in the handle portion 7 is a rechargeable battery 10 and a socket 11 into which a plug (not shown) can be inserted to recharge the battery 10. The battery 10 is connected to an on/off switch 12 and the switch 12 and the battery 10 are connected to an electric motor 13. The motor 13 is mounted in a spider 14 and is driveably coupled to a fan 15 which has an air inlet portion 16 formed as a tubular member and located in a central aperture in a disc 17 which forms the right-hand end of the housing portion 4. A slider 18 is located immediately behind a push-button 19 of the switch 12, the slider being engaged with a slidable part 20 within the housing 5 and the slidable part 20 having a forward end 21 which is bifurcated and the arms of which can pass on either side of a stem 22 of the push-button 19 such that, when the slider 18 is moved to a forward position, the arms 21 prevent the push-button 19 being depressed and thus the contacts of the switch 12 being closed.

Figure 4:
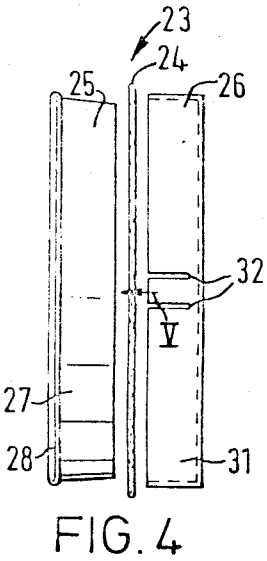
FIG. 4 shows an exploded view of a filter arrangement.
Figure 5:
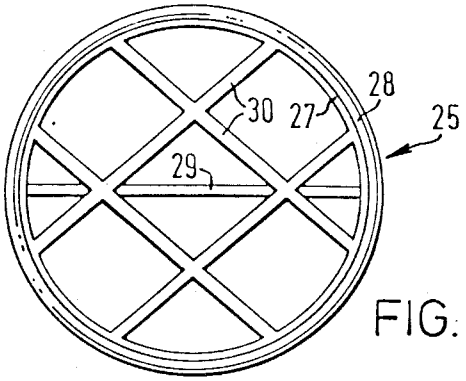
FIG. 5 is a view taken in the direction of arrow V of FIG. 4.

FIG. 4 shows that a filter arrangement 23 comprises a flexible disc 24 of filter material such as a fine felt and two annular members 25 and 26. FIG. 5 shows that the member 25 has an outer cylindrical wall 27, a flange 28, a diametrically extending rib 29 and a grid arrangement 30. The member 26 is of cup shape with an end wall having a large aperture therein and a cylindrical wall 31 having pairs of slits 32 therein which render it generally flexible. If the member 26 is pressed over the member 25 with the flexible disc 24 located therebetween, the disc 24 will over-lie the grid 30 of the member 25 and the member 26 will be retained on the member 25 by the flexibility of the cylindrical wall 31 thereof caused by the slits 32. The forward end of the housing portion 5, that is to say forward of the end wall 17, has projecting plugs 17*a* which engage within the cylindrical wall 27 of the member 25 and locate the filter arrangement 23 in position.

Figure 6:
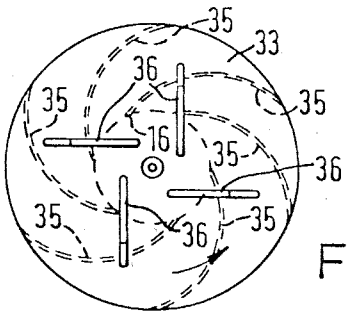
FIG. 6 is a view taken on line VI—VI of FIG. 3.

FIG. 6 shows that the fan 15 has a pair of spaced discs 33 and 34, with webs 35 extending from the periphery of the fan between the discs 33 and 34 to an inner position which lies on the periphery of the aperture defined by the tubular member 16 of the fan. As shown six webs 35 are provided. On the rear face of the disc 33, four ribs 36 are provided so that upon rotation of the fan 15 by the motor 13 the ribs 36 will cause air flow into apertures 37 provided in the forward end wall of the motor 13 thereby to cause air flow through the motor 13 and through outlet apertures 38 provided in the side wall of the motor, the air passed through the motor leaving the housing portion 4 through the slots 8 and the air driven by the fan 15 passing out of the housing portion 4 through the slots 9.

The vacuum cleaner 1 can be used at an approximate inclination of 45° to a horizontal surface being cleaned and dirt and grit sucked in through the inlet nozzle 3 will be stopped by the disc 24 of filter material and held against the underside of the disc 24 by the air flow. The motor 13 can be kept running until the cleaner is located over a waste bin, switching off of the motor then allowing large portions of grit to fall through the nozzle 3 into the bin or alternatively the cleaner 1 can be tilted to a generally horizontal orientation before the motor 13 is turned off so that large portions of grit will fall from the filter disc into the front portion 2 of the housing subsequently to be tipped out.

What is claimed is:

1. A rechargeable vacuum cleaner comprising a housing formed to present an intake nozzle, a body portion and a handle portion, wherein said body portion mounts a motor fan suction unit and a filter arrangement and has outlet apertures therein for air from said motor fan suction unit and said handle portion provides means for holding the rechargeable vacuum cleaner, houses a rechargeable battery and incorporates a socket whereby said battery can be connected to charging means therefore, wherein said filter arrangement comprises:

a disc of flexible filter material so mounted as completely to obstruct a passageway within said housing for air flowing from said intake nozzle to said motor fan suction unit such that all air passing through said passageway must pass through said disc of flexible filter material;

inner and outer annular members sandwiching therebetween said disc of flexible filter material, each of said two annular members includes a cylindrical wall with said cylindrical walls telescoped within each other, the inner one of said two annular members defines a grid frameword, the outer one of said two annular members is cup shaped and has slits in its said outer cylindrical wall to make said outer cylindrical wall flexible;

said disc of flexible filter material is stretched over said grid framework when said inner one of said two members is telescopically received and retained within said outer one of said two members with said disc of flexible filter material located therebetween; and a forward part of said body portion has projecting plugs to engage within said inner cylindrical wall of said inner one of said two annular members to locate the filter arrangement on said body portion.

2. A rechargeable vacuum cleaner as claimed in claim 1, wherein said motor fan suction unit comprises: a motor having an upstream end plate and being mounted on a spider received and located within said body portion, which said body portion is provided in two parts with the joint face between said two parts lying in a plane extending generally parallel to the axis of said motor fan suction unit; the fan of said unit is of the centrifugal kind comprising a pair of spaced discs with arcuate webs extending therebetween, each of said arcuate webs extending from an outer periphery generally towards the center with an upstream one of said pair of discs having a central aperture therein for air inlet, and wherein said downstream one of said pair of discs bears, on its downstream face, ribs which cause flow of a current of air onto an upstream end plate of the motor of said unit, which said upstream end plate is apertured to enable the air flow to pass through said motor and out of apertures adjacent the downstream end of said motor, said ribs comprising four linear ribs provided with their inner ends lying at the four corners of a square which has the axis of said fan at its center and the four outer ends lying at the four corners of a further square and with the said square and said further square axially rotated with respect to one another through 45 degrees.

* * * * *